US006457971B2

(12) United States Patent
Orbeck

(10) Patent No.: US 6,457,971 B2
(45) Date of Patent: Oct. 1, 2002

(54) CONTINUOUS FURNACE HAVING TRAVELING GAS BARRIER

(75) Inventor: Gary Orbeck, Windham, NH (US)

(73) Assignee: BTU International, Inc., North Billerica, MA (US)

( * ) Notice: Subject to any disclaimer, the term of this patent is extended or adjusted under 35 U.S.C. 154(b) by 0 days.

(21) Appl. No.: 09/943,233

(22) Filed: Aug. 30, 2001

Related U.S. Application Data

(63) Continuation-in-part of application No. 09/438,073, filed on Nov. 10, 1999, now Pat. No. 6,283,748.

(60) Provisional application No. 60/139,612, filed on Jun. 17, 1999.

(51) Int. Cl.[7] ..... F27D 3/04

(52) U.S. Cl. ..... 432/126; 432/121

(58) Field of Search ..... 432/121, 125, 432/126, 129, 128, 153; 219/388, 402; 266/176, 177, 180; 414/147, 150

(56) References Cited

U.S. PATENT DOCUMENTS

| | | | | |
|---|---|---|---|---|
| 3,584,847 A | | 6/1971 | Hammond, Jr. et al. | 432/126 |
| 3,982,887 A | | 9/1976 | Kendziora et al. | 432/128 |
| 4,022,570 A | | 5/1977 | Ross, Jr. et al. | 432/129 |
| 4,029,489 A | | 6/1977 | Froberg et al. | 65/136 |
| 4,073,874 A | | 2/1978 | Fukushima | 423/500 |
| 4,194,990 A | | 3/1980 | Pieters et al. | 252/441 |
| 4,205,935 A | | 6/1980 | Edler et al. | 414/152 |
| 4,263,163 A | | 4/1981 | Ross | 252/301.1 W |
| 4,389,332 A | | 6/1983 | Ross | 252/378 R |
| 4,403,953 A | * | 9/1983 | Suzuki | 432/126 |
| 4,416,623 A | | 11/1983 | Takahashi | 432/36 |
| 4,421,481 A | | 12/1983 | Holz et al. | 432/126 |
| 4,457,703 A | | 7/1984 | Ross | 432/13 |
| 4,496,477 A | | 1/1985 | Ross | 252/629 |
| 4,518,417 A | | 5/1985 | Lugscheider et al. | 75/10 R |
| 4,574,182 A | | 3/1986 | Pescatore et al. | 219/388 |
| 4,586,898 A | | 5/1986 | Orbeck | 432/122 |
| 4,627,814 A | | 12/1986 | Hattori et al. | 432/128 |
| 4,847,465 A | | 7/1989 | Toyama et al. | 219/85.1 |
| 4,932,864 A | | 6/1990 | Miyabe | 432/128 |
| 4,966,547 A | | 10/1990 | Okuyama et al. | 432/9 |
| 5,078,368 A | | 1/1992 | Hemsath | 266/236 |
| 5,117,564 A | * | 6/1992 | Taguchi et al. | 432/152 |
| 5,314,330 A | | 5/1994 | Orbeck | 432/128 |
| 5,338,008 A | | 8/1994 | Okuno et al. | 266/105 |
| 5,440,101 A | | 8/1995 | Cox et al. | 219/388 |
| 5,443,383 A | | 8/1995 | Kuehn | 432/122 |
| 5,542,595 A | | 8/1996 | Gibson | 228/207 |
| 5,714,113 A | | 2/1998 | Gitman et al. | 266/182 |
| 5,788,921 A | | 8/1998 | Gitman et al. | 266/225 |
| 5,843,368 A | | 12/1998 | Gitman et al. | 266/182 |
| 5,858,302 A | | 1/1999 | Gitman et al. | 266/182 |

FOREIGN PATENT DOCUMENTS

| | | |
|---|---|---|
| DE | 906071 | 3/1954 |
| DE | 1758132 | 12/1970 |
| DE | 2045776 | 3/1972 |
| FR | 505035 | 7/1920 |
| GB | 975584 | 11/1964 |
| WO | WO 92/08940 | 5/1992 |

* cited by examiner

*Primary Examiner*—Gregory Wilson
(74) *Attorney, Agent, or Firm*—Weingarten, Schurgin, Gagnebin & Lebovici LLP

(57) ABSTRACT

A continuous pusher furnace includes a product carrier assembly incorporating a traveling gas barrier. The product carrier assembly comprises a plate disposed to receive product thereon and a gas barrier extending upwardly from the plate. The perimeter of the gas barrier is sized and configured to fit within a vestibule between heating chambers in the furnace with a clearance gap with the vestibule selected to increase a gas flow velocity through the vestibule sufficient to overcome a gas diffusion velocity through the vestibule in a direction opposite to the gas flow. In this manner, gas is unable to diffuse into an upstream heating chamber. In an alternative embodiment, an exhaust outlet may also be provided in the vestibule or chamber to exhaust gas from upstream and downstream heating chambers from the furnace.

15 Claims, 5 Drawing Sheets

FIG. 4
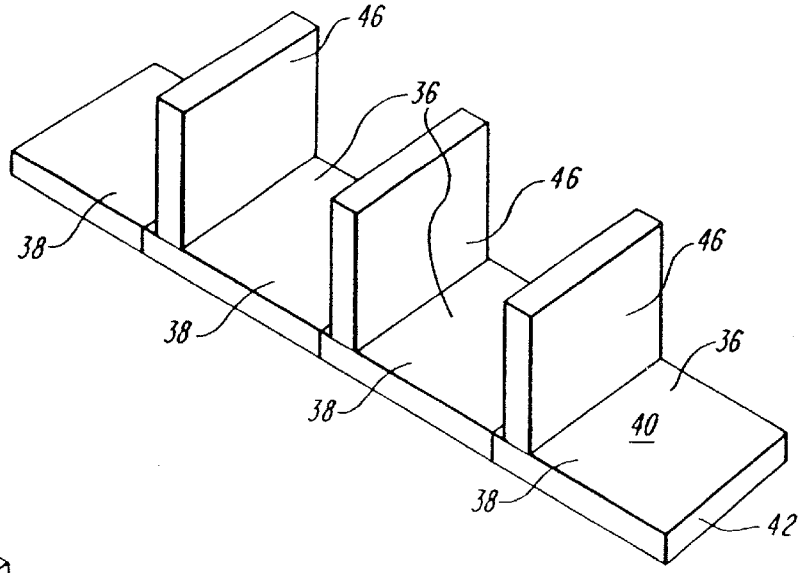
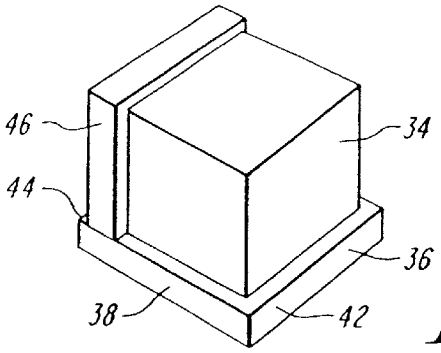
FIG. 5
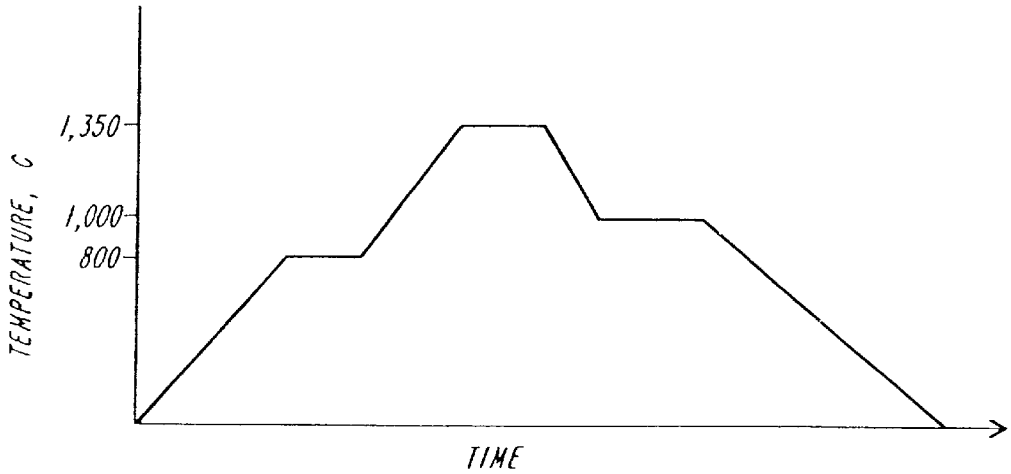
FIG. 6

CONTINUOUS FURNACE HAVING TRAVELING GAS BARRIER

CROSS REFERENCE TO RELATED APPLICATIONS

This application claims priority under 35 U.S.C. § 119(e) of U.S. Provisional Application Serial No. 60/139,612 filed Jun. 17, 1999, the disclosure of which is incorporated by reference herein.

This application is a continuation-in-part of application Ser. No. 09/438,073, filed Nov. 10, 1999, now U.S. Pat. No. 6,283,748, the, disclosure of which is incorporated by reference herein.

STATEMENT REGARDING FEDERALLY SPONSORED RESEARCH OR DEVELOPMENT

N/A

BACKGROUND OF THE INVENTION

Continuous furnaces are used for a variety of applications, such as the manufacture of electronic components. These furnaces often have a set of thermal or heating chambers within each of which the temperature and composition of the atmosphere are controlled. Product is advanced sequentially through each chamber at a determined rate to achieve a desired thermal and atmosphere profile.

Product may be advanced through continuous furnaces in various manners, for example, in one type of continuous furnace, the product sits on a metal mesh belt which pulls the product through the furnace. In another type, a continuous pusher furnace, the product is placed on plates or carriers or boats that are pushed into the entrance of the furnace. Each subsequent plate pushes the plate in front of it. A line of contacting plates is advanced by pushing on the rearmost plate in the line.

Often, it is desirable to operate two chambers within a continuous furnace at different atmospheres that must be kept separated. Typically, the chambers are spaced by tunnels or vestibules. Often doors at the entrance and exit of the chambers are provided to retain the atmosphere within the chamber. These doors, however, are costly and complex. To close the door in a continuous pusher furnace, product carriers in a contacting line must be separated, for example, by pushing the carrier at the head of the line at 90° to move it off the line of travel and into a purge chamber or furnace section. A door is then closed behind the isolated carrier and the chamber purged. The carrier may than be advanced to the next chamber by another pusher along a line offset from the first line. This procedure must be repeated for each carrier. This requires additional furnace length, cost, and multiple pushers.

SUMMARY OF THE INVENTION

In the present invention, a continuous furnace incorporates a traveling gas barrier to create a barrier to open gas travel between the furnace chambers. During operation of the furnace, gas flows from one heating chamber, an upstream chamber, to an adjacent heating chamber, a downstream chamber. At the same time, gas may try to diffuse from the downstream heating chamber toward the upstream heating chamber, against the gas flow. The magnitude of the diffusion velocity could be greater than the magnitude of the gas flow velocity, in which case the composition of the atmosphere in the upstream chamber could be altered as the diffusing gas enters the upstream chamber. In the present invention, diffusion of gas from the downstream chamber into the upstream chamber is prevented by a gas barrier that travels with product through the furnace. The gas barrier ensures sufficient downstream gas velocity to overcome diffusion.

More particularly, the continuous pusher furnace has at least one heating chamber and typically a plurality of heating chambers. Vestibules interconnect the heating chambers. Entrance and exit vestibules are also typically provided. Gas containment from the process chambers to the outside through the entrance and exit vestibules operates in the same manner as chamber-to-chamber separation.

Each product carrier assembly comprises a pusher plate disposed to receive product thereon and a gas barrier extending upwardly from the pusher plate. The gas barrier has a perimeter sized and configured to fit within the vestibule with a clearance gap between the perimeter and the vestibule walls that increases the gas flow velocity through the vestibule sufficiently to overcome the gas diffusion velocity through the vestibule in a direction opposite to the gas flow. The traveling gas barrier of the present invention thus prevents diffusion of gas into the upstream chamber. The traveling gas barrier allows the furnace heating chambers to be aligned along a single line, thereby minimizing the size of the furnace. The need for complex doors and multiple pushers is eliminated, and product may be moved through the furnace more rapidly and efficiently.

In an alternative embodiment, one or more exhaust outlets are additionally provided in the vestibule or chambers to exhaust gas from both the upstream chamber and the downstream chamber out of the furnace. The length of the vestibule is selected to allow sufficient opportunity for the gas to be exhausted through the exhaust outlets.

DESCRIPTION OF THE DRAWINGS

The invention will be more fully understood from the following detailed description taken in conjunction with the accompanying drawings in which:

FIG. 4 is an isometric view of a row of gas barrier pusher plates according to the present invention;

FIG. 5 is an isometric view of a gas barrier pusher plate with product according to the present invention;

FIG. 6 is a process profile for the firing of ceramic capacitors;

DETAILED DESCRIPTION OF THE INVENTION

Figure 1:
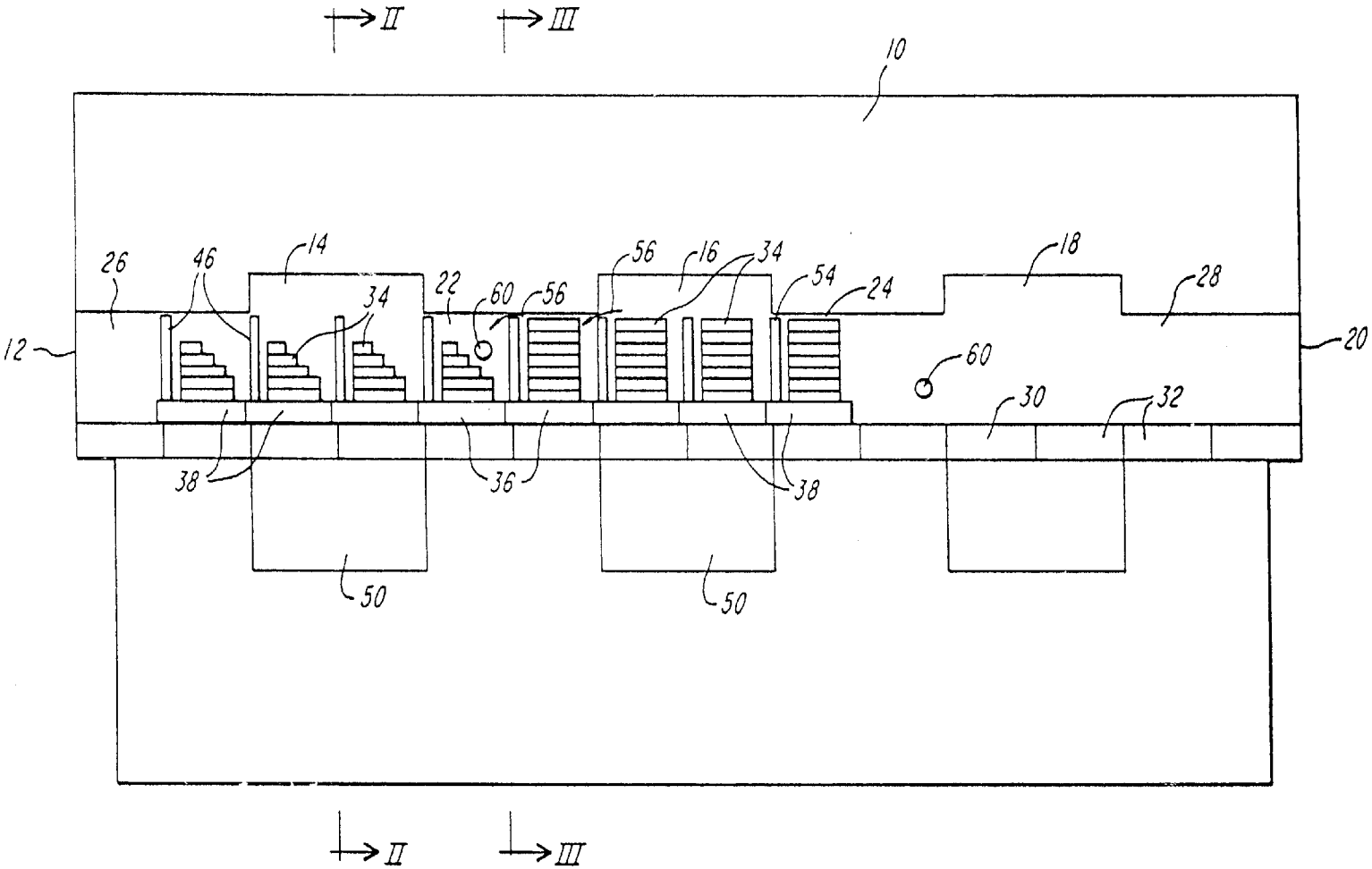
FIG. 1 is a cross-sectional view of a continuous pusher furnace with gas barrier pusher plates according to the present invention shown halfway down the furnace length.
Figure 2:
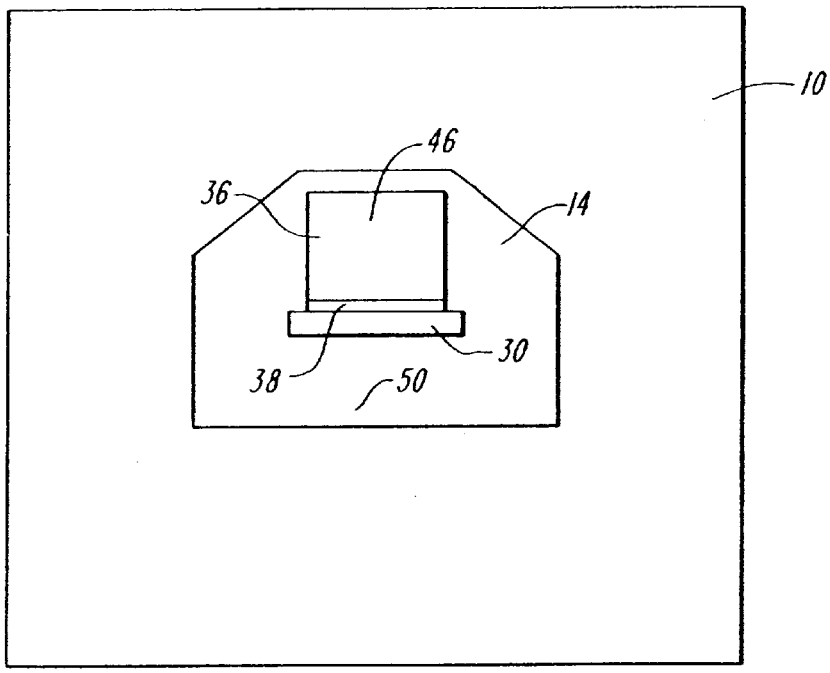
FIG. 2 is a cross-sectional view taken along line II—II of FIG. 1.
Figure 3:
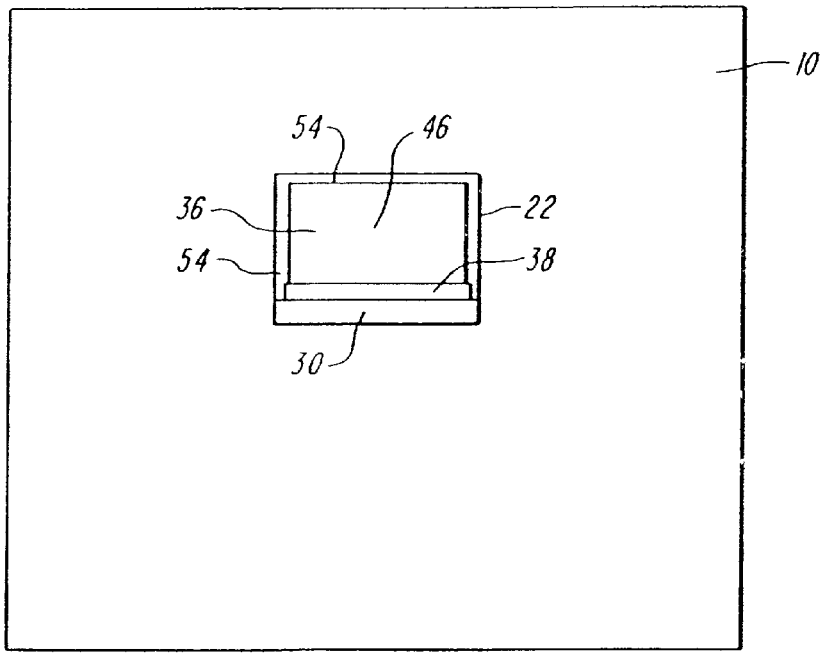
FIG. 3 is a cross-sectional view taken along line III—III of FIG. 1.

FIGS. 1–5 illustrate a continuous pusher furnace 10 of the present invention having an entrance 12, a number of thermal or heating chambers 14, 16, 18, and an exit 20. Vestibules 22, 24 or tunnels interconnect the heating chambers 14, 16, 18. An entrance vestibule 26 is provided between the entrance 12 and the first heating chamber 14, and an exit vestibule 28 is provided between the last heating chamber 18 and the exit 20. Although three heating chambers are shown, one or any other number of heating chambers may be provided, depending on the application. The vestibules 22, 24, 26, 28 are the same size or smaller in cross-sectional area than the heating chambers 14, 16, 18, as best seen in a comparison of FIGS. 2 and 3. A hearth surface 30, which may be formed from a series of hearth plates 32, extends the length of the furnace from the entrance 12 to the exit 20. Product 34 resting on product carrier assemblies 36 is pushed along the hearth surface 30 from the entrance 12 through the heating chambers 14, 16, 18 and vestibules 22, 24, 26, 28, to the exit 20. Each heating chamber functions in a manner known in the art to heat product therein to the desired temperature at a predetermined composition of atmosphere.

Each carrier assembly 36 comprises a pusher plate 38 and gas barrier 46 that slide over the hearth surface 30. Product 34 rests on the flat surface 40 of the pusher plate. The pusher plate is typically square or rectangular. The plate typically has a front or leading edge 42 facing the direction of product travel and a rear or trailing edge 44 that is contacted by a pusher or a subsequent pusher plate. The gas barrier 46 extends upwardly from the pusher plate 38. The gas barrier 46 is formed as a wall that extends in a plane transverse to the direction of product travel. Preferably, the gas barrier is located near or at the trailing edge 44 of the pusher plate. The gas barrier may also extend upwardly from other locations, as long as sufficient area is provided on the pusher plate to retain product. For example, the gas barrier may extend upwardly from at or near the leading edge 42. In another configuration, the gas barrier may extend upwardly from a central location, leaving product area in front of and behind the gas barrier. The gas barrier is attached to the pusher plate so that it is able to travel with the pusher plate as the carrier assembly and the product thereon is advanced through the furnace.

During operation of the furnace, gas flows from one heating chamber, an upstream chamber, for example, chamber 16, through the adjacent vestibule 22 to the next closest downstream heating chamber, for example, chamber 14. It will be appreciated that the gas flow may be in the same direction as the product travel or in the opposite direction; the terms upstream and downstream are used in this context to refer to the direction of gas flow. At the same time, gas attempts to diffuse in the opposite direction from the gas flow, that is, from the downstream heating chamber 14 to the upstream heating chamber 16.

For example, lacking the present invention, trace hydrogen gas in the downstream heating chamber 14 may diffuse upstream against the flow of the gas. The magnitude of the diffusion velocity may also be greater than the magnitude of the flow velocity. In this case, over time, the composition of the atmosphere in the upstream heating chamber 16 may be altered by introduction of gas from the downstream heating chamber 14. This alteration of the atmosphere may or may not be acceptable to a given application.

The carrier assembly 36 of the present invention provides a barrier to prevent gas diffusion against the gas flow. The gas barrier 46 is sized and configured to fit within the vestibule with only a small clearance gap 54 between the vestibule walls and roof and the perimeter of the gas barrier. Gas flowing through the vestibule must therefore pass through this small gap, indicated by the arrows 56 in FIG. 1. Because of the reduced cross-sectional area and the length of the gas barrier along the gas flow path caused by the small gap, the velocity of the gas increases as the gas flows over and around the gas barrier. The smaller the cross-sectional area of the gap, the greater the increase in gas flow velocity. The gap size is selected to increase the magnitude of the gas flow velocity, over a calculated length, sufficiently to be greater than the magnitude of the diffusion velocity. In this manner, gas is unable to diffuse upstream against the gas flow.

The size and length of the gap 54 are chosen based on several considerations to achieve a sufficiently large gas flow velocity. One factor is the size of the gas supply used in the process. A larger gas supply provides a greater gas flow velocity. Thus, for large gas supplies, a larger gap may suffice to increase the gas flow velocity sufficiently to overcome the gas diffusion velocity. Another factor is the tolerance achievable with the material from which the gas barrier is formed. For example, a brick material cannot provide as close a tolerance as a metal material. Thus, if a small gap with a tight tolerance is needed, a suitable material to achieve that tolerance should be selected. A further factor is the amount, if any, of diffused gas that can be tolerated in the upstream heating chamber.

The pusher plate and the gas barrier may be made of any suitable material, such as a metal or a ceramic or other refractory, that can withstand the environment inside the furnace, as is known in the art. The gas barrier may be attached to the pusher plate in any suitable manner, such as with screws, adhesive, or any other fastening device or method or by retention in a retaining groove. The gas barrier may be removable from the pusher plate if desired. The gas barrier need not be fixedly attached to the pusher plate. It could be gravity-loaded onto the pusher plate. The gas barrier and the pusher plate may also be formed as a single unitary member. Also, the barrier may be a separate piece from the pusher plate, for example, to be inserted between each pusher plate.

In the situation described above, gas flowing from the upstream chamber is able to enter the downstream chamber. In many applications, this mixing of atmospheres in the downstream chamber is acceptable. In some applications, however, it is not desirable to allow the upstream gas to enter the downstream chamber. Thus, in an alternative embodiment, one or more exhaust outlets 60 may be provided in the vestibule or the firing chambers. In FIG. 1, a single exhaust outlet is shown in each vestibule 22 and 24. Some or all of the upstream gas is exhausted through this outlet. Thus, when the exhaust outlet is used in conjunction with the traveling gas barrier of the present invention, both upstream gas may be prevented from entering the downstream chamber and downstream gas may be prevented from entering the upstream chamber. The exhaust outlet may be any suitable exhaust outlet, for example, open to the atmosphere or incorporating a fan or vacuum source, as known in the art. The length of the vestibule is selected to allow sufficient exhaust outlets to remove the gases along with a given number of gas barriers in the vestibule.

The present invention may be further understood in conjunction with an example, such as the manufacture of ceramic capacitors. FIG. 6 illustrates a typical firing profile of ceramic capacitors. Three heating chambers are used. The product is held in a reducing atmosphere in a first heating chamber, for example chamber 14, of nitrogen and trace hydrogen at 800° C. for a predetermined time. There can be only a negligible amount of oxygen in this chamber (for example, partial pressure of oxygen may be approximately $10^{-20}$ atm). The product is advanced to a second or center heating chamber, chamber 16, for firing at 1350° C. in a nitrogen and oxygen atmosphere. The partial pressure of the oxygen in this chamber is approximately 10–11 to 10–12 atm. This is followed by reoxidation in a third or last heating chamber, chamber 18, at 1000° C. in an atmosphere of nitrogen and a greater amount of oxygen. The partial pressure of the oxygen is approximately $10^{-4}$ atm.

In this process, gas tends to flow out of the center chamber 16 toward both the first heating chamber 14 and the last heating chamber 18. Hydrogen tends to diffuse from the first chamber 14 to the center chamber 16. The traveling gas barrier 46 of the present invention prevents this diffusion of hydrogen toward the center chamber 16. Although some dilution of the atmospheres in the first and last chambers 14, 18 with atmosphere from the center chamber 16 can be tolerated in this process, the exhaust outlets 60 in the vestibule between the first chamber and the center chamber and between the center chamber and the last chamber minimize this dilution.

The traveling gas barrier of the present invention may also be used to prevent room atmosphere from entering the first heating chamber 14 through the entrance vestibule 26 or to prevent room atmosphere from entering the last heating chamber 18 through the exit vestibule 28.

Figure 7:
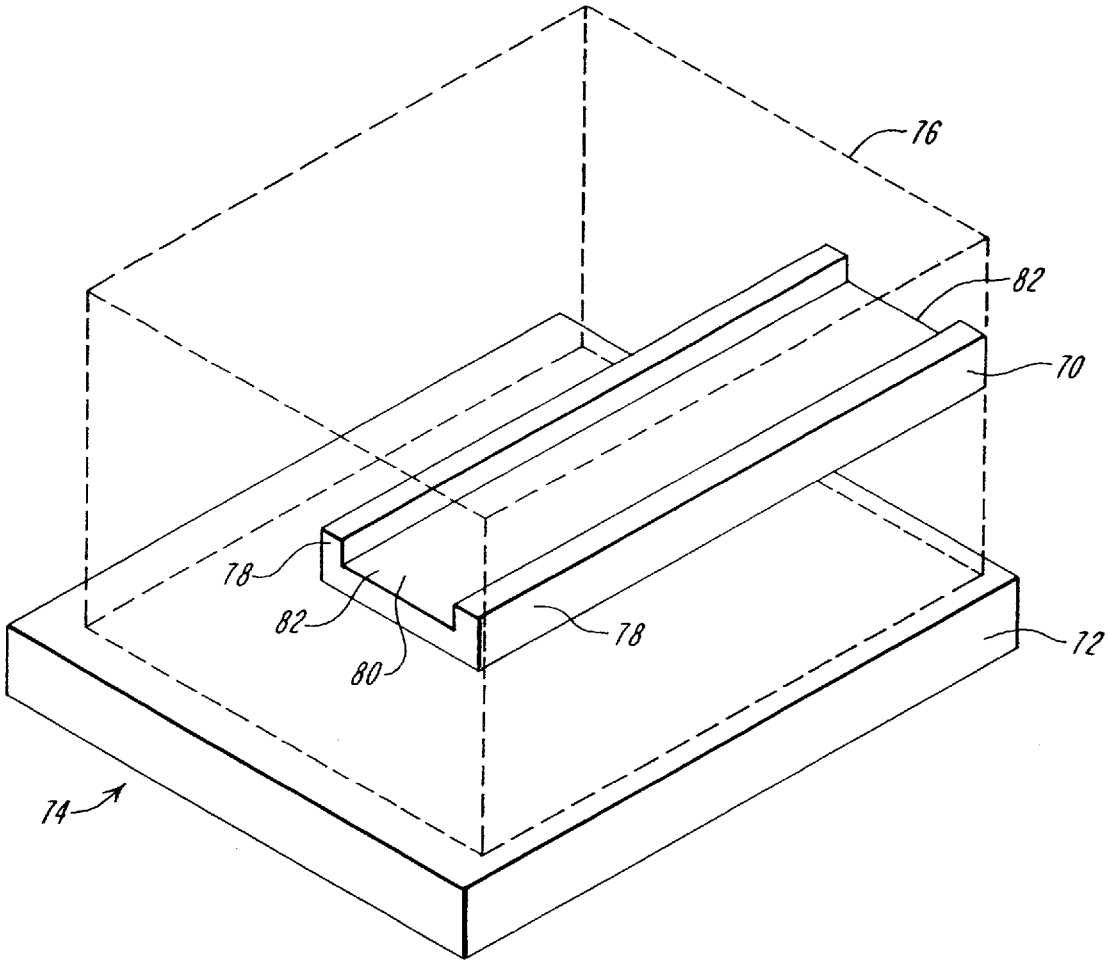
FIG. 7 is an isometric view of a further embodiment of a gas barrier according to the present invention.
Figure 8:
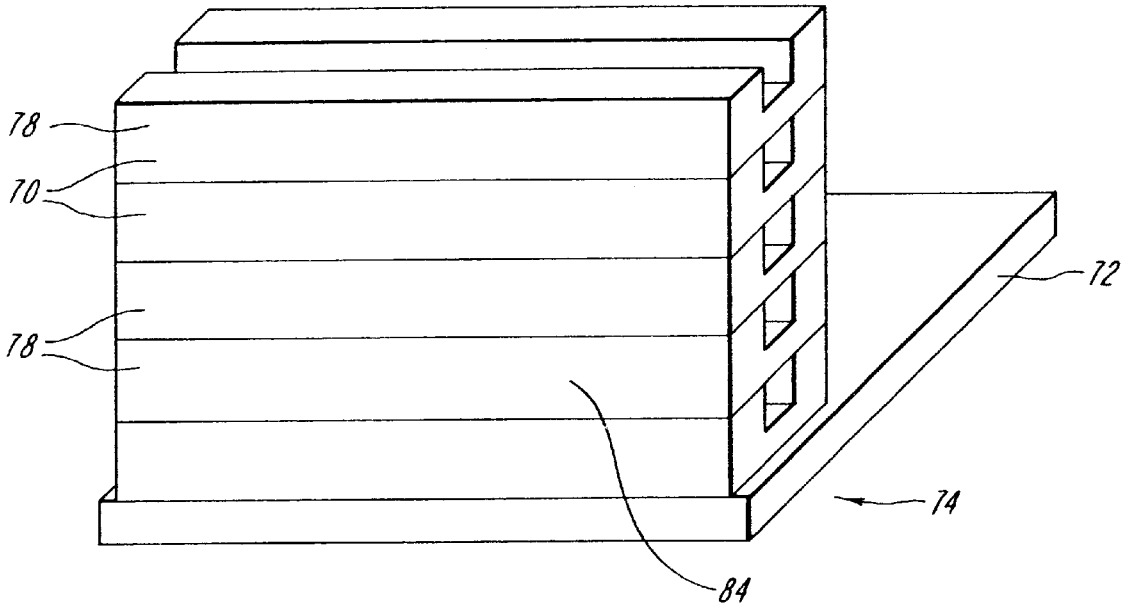
FIG. 8 is a further isometric view of the embodiment of FIG. 7.

A further embodiment of a gas barrier is described in conjunction with FIGS. 7 and 8, in which a number of product elements are stacked vertically to form a gas barrier. In the embodiment illustrated, the product elements are formed from a number of support trays 70 in which product is carried through the furnace. The trays are vertically stacked in rows on the pusher plate 72 of a carrier assembly 74. For clarity, only one tray is illustrated in FIG. 7. Dotted lines 76 indicate the volume that may be filled with the stacked trays 70. In the embodiment illustrated, each tray 70 has upstanding walls 78 extending lengthwise, a floor 80 on which product (not shown) is placed, and open ends 82 to allow free gas travel for both heating and atmosphere contact with the product.

The trays 70 are configured such that, when stacked vertically, the upstanding walls 78 form a vertical wall 84, illustrated in FIG. 8. The trays are arranged on the pusher plate 72 so that the wall 84 extends in a plane transverse to the direction of product travel through the furnace. The trays are configured such that the wall is sized and configured to fit within the vestibule with only a small clearance gap between the vestibule walls and the roof and the perimeter of the stacked trays. The size and length of the gap are chosen to achieve a sufficiently large gas flow velocity, as described above. It will be appreciated that other tray configurations or arrangements or the product itself, if of an appropriate configuration, may be provided to form the wall.

The invention is not to be limited by what has been particularly shown and described, except as indicated by the appended claims.

I claim:

1. A continuous furnace comprising:

at least one heating chamber and at least one vestibule adjoining the heating chamber, and a hearth surface defining a product path through the heating chamber and through the vestibule; and a carrier assembly comprising a plate disposed to receive product thereon and a gas barrier comprising vertically stacked product elements extending transversely across the product path to form a barrier wall having a perimeter, the barrier wall sized and configured to fit within the vestibule with a clearance gap between the perimeter and the vestibule, wherein the clearance gap and length are selected to increase a gas flow velocity through the vestibule sufficient to overcome a gas diffusion velocity through the vestibule in a direction opposite to the gas flow local to the perimeter of the gas barrier.

2. The furnace of claim 1, wherein the product elements comprise product trays configured to receive product thereon.

3. The furnace of claim 2, wherein each of the product trays comprises a floor and at least one upstanding wall, the upstanding walls of each of the product trays forming the barrier wall.

4. The furnace of claim 1, further comprising a plurality of carrier assemblies.

5. The furnace of claim 1, wherein a cross-sectional area of the vestibule is smaller or the same size as the cross-sectional area of the heating chamber.

6. The furnace of claim 1, wherein the product path lies along a straight line from an entrance of the furnace to an exit of the furnace.

7. The furnace of claim 1, further comprising at least a second heating chamber, the vestibule interconnecting the at least one heating chamber and the second heating chamber.

8. The furnace of claim 7, wherein the product path lies along a straight line from the one heating chamber to the second heating chamber.

9. The furnace of claim 1, wherein the vestibule comprises an entrance vestibule located adjacent to a product entrance in the heating chamber.

10. The furnace of claim 1, wherein the vestibule comprises an exit vestibule located adjacent to a product exit in the heating chamber.

11. The furnace of claim 1, further including at least one exhaust outlet in the vestibule or furnace chamber.

12. The furnace of claim 11, wherein the vestibule is sufficiently long to allow all gas to be exhausted through the at least one exhaust outlet.

13. The furnace of claim 1, wherein the carrier assembly is formed of a material capable of withstanding a heated environment in the furnace.

14. The furnace of claim 1, wherein the carrier assembly is formed of a refractory material.

15. The furnace of claim 1, wherein the furnace comprises a continuous pusher furnace.

* * * * *

UNITED STATES PATENT AND TRADEMARK OFFICE

CERTIFICATE OF CORRECTION

PATENT NO. : 6,457,971 B2
DATED : October 1, 2002
INVENTOR(S) : Gary Orbeck

It is certified that error appears in the above-identified patent and that said Letters Patent is hereby corrected as shown below:

Column 5,
Line 1, "10-11 to 10-12" should read -- $10^{-11}$ to $10^{-12}$ --.

Signed and Sealed this

Seventeenth Day of June, 2003

JAMES E. ROGAN
*Director of the United States Patent and Trademark Office*